US007923640B2

(12) United States Patent
Fischbacher

(10) Patent No.: US 7,923,640 B2
(45) Date of Patent: Apr. 12, 2011

(54) HIGH CURRENT CABLE

(75) Inventor: Christian Fischbacher, Heiden (CH)

(73) Assignee: CFW EMV-Consulting AG (CH)

( * ) Notice: Subject to any disclaimer, the term of this patent is extended or adjusted under 35 U.S.C. 154(b) by 129 days.

(21) Appl. No.: 12/301,036

(22) PCT Filed: May 7, 2007

(86) PCT No.: PCT/CH2007/000229

§ 371 (c)(1),
(2), (4) Date: Nov. 17, 2008

(87) PCT Pub. No.: WO2007/143865

PCT Pub. Date: Dec. 21, 2007

(65) Prior Publication Data

US 2009/0218115 A1 Sep. 3, 2009

(30) Foreign Application Priority Data

Jun. 14, 2006 (CH) ..... 964/06

(51) Int. Cl.
*H01B 9/00* (2006.01)

(52) U.S. Cl. ..... 174/113 R

(58) Field of Classification Search ..... 174/113 R
See application file for complete search history.

(56) References Cited

U.S. PATENT DOCUMENTS 5,864,094 A * 1/1999 Griffin ..... 174/105 R
6,628,009 B1 * 9/2003 Chapel ..... 307/14

FOREIGN PATENT DOCUMENTS

CA 996645 9/1976

* cited by examiner

*Primary Examiner* — Chau N Nguyen
(74) *Attorney, Agent, or Firm* — Galbreath Law Offices, P.C.; John A. Galbreath

(57) ABSTRACT

The heavy current cable (1) for 50/60 Hz TN-S mains comprises preferably a central earth connector (2), around which three phase leads (3, 4, 5) and a neutral lead (6) are stranded. The earth lead (2) can have a smaller cross-section than the phase leads (3, 4, 5) and the neutral lead (6), and can be straight. This heavy current cable (1) is characterised by a defined cable reactance, by a constant current distribution over the phase cables and by the avoidance of any induction currents. In addition virtually no interference can be coupled into parallel lying I & C-leads. There is only a low level of NIS-radiation and no short-circuiting forces. Finally, there is a time saving during installation.

6 Claims, 1 Drawing Sheet

HIGH CURRENT CABLE

BACKGROUND OF THE INVENTION (1) Field of the Invention

The present invention relates to a high current cable for 50/60 Hz TN-S mains.

(2) Description of Related Art

It was and is believed that in electrical indoor installations consistent wiring according to TN-S ensures an operation free of ground current. This is as a result of guiding the grounding conductor separately from the distribution point in the building, i.e. that the grounding conductor is to be without current during operation.

However, measurements in the vicinity of indoor installations has shown, again and again, the opposite, namely, that the grounding conductor has high currents in spite of TN-S installation, especially when the phase, neutral and ground conductors are installed as single conductors next to each other. As shown in theoretical and practical tests, these ground conductor currents are caused by induction. Depending on the cross section of the conductor the currents induced in the grounding conductor can reach significant levels i.e. between 10% and 20% of the highest phase current. Furthermore, cables installed this way also induce currents in adjacent metal constructions like cable lines, air, water and/or gas pipes, iron reinforcements etc. The results are unexplainable increases in the magnetic field and problems with EMC and corrosion.

BRIEF SUMMARY OF THE INVENTION

Based on this realization the invention undertakes the task to create a high current cable for 50/60 Hz TN-S mains that will avoid the mentioned disadvantages to a large extent. The high current cable according to the invention conforms to the characteristic features of patent claim 1. Further advantageous embodiments of the invention are apparent from the dependent patent claims.

The heavy current cable for 50/60 Hz TN-S mains therefore comprises at least one ground connector, around which several phase connectors and at least one neutral connector are stranded.

BRIEF DESCRIPTION OF THE DRAWINGS

Subsequently a preferred exemplary embodiment of the invention is described in more detail by means of the drawing.

DETAILED DESCRIPTION OF THE INVENTION

Figure 1:
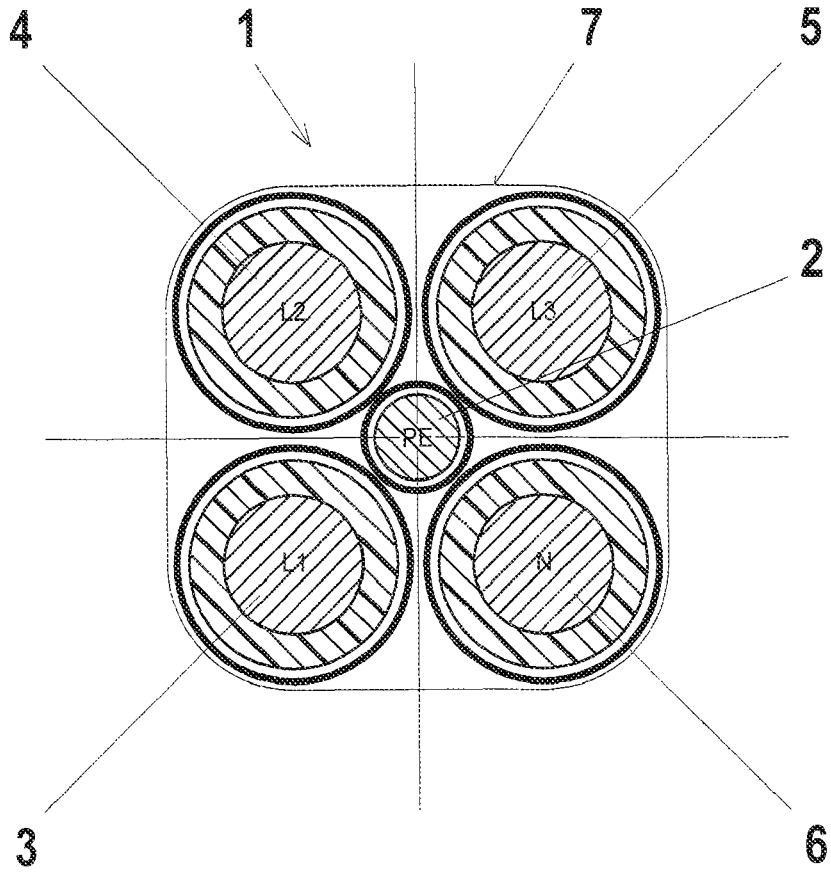
FIG. 1 shows a cross section of the high current cable.

In the present example the high current cable 1 comprises a ground conductor 2 around which three phase conductors 3, 4, and 5 and one neutral conductor 6 are grouped.

The ground conductor can have a smaller cross section than the phase conductors 3, 4, and 5 and the neutral conductor 6 and can be straight. The phase conductors 3, 4, and 5 are flexible and don't need to be shielded. The high current cable 1 can be wrapped with a strap 7.

Figure 2:
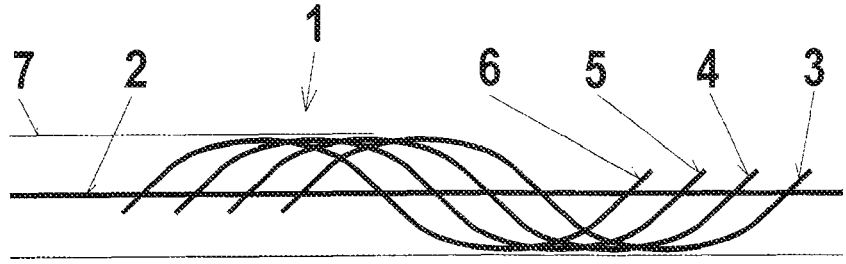
FIG. 2 shows a schematic view of the same high current cable.

The high current cable 1 is stranded by stranding the three phase conductors 3, 4, and 5 and the neutral conductor 6 as outer conductors around the ground conductor 2. Thus, the latter forms a continuous cable core as schematically evident from FIG. 2. The neutral conductor 6 is also stranded around the ground conductor 2. The stranding factor of the stranding of the outer conductors, i.e. the phase conductors 3, 4, and 5 and the neutral conductor 6 is advantageously <1 m. Otherwise the precise method of stranding is not part of the invention.

One advantage of this embodiment of the high current cable 1 is that it remains flexible even with large conductor cross sections and therefore can be installed without problems. Therefore the high current cable 1 can easily be used in indoor installation.

The high current cable according to the invention provides the following enormous advantages:

- defined cable reactance,
- even current distribution over phase conductors 3, 4, and 5,
- no induction currents to ground conductor 2 through the outer conductors, i.e. through the phase conductors 3, 4, and 5 and the neutral conductor 6,
- no induction currents to the outer conductors, i.e. to the phase conductors 3, 4, and 5 and the neutral conductor 6 from adjacent power cables,
- no induction currents to adjacent metal constructions like cable lines, cable supports, ground loops and air, water and/or gas pipes,
- virtually no interference coupling into parallel I&C conductors,
- low level of NIS radiation
- no short-circuiting forces,
- time saving during installation,
- suitable for parallel operation.

It is within the scope of the invention to design details of the high current cable differently from the illustration in the schematic drawing.

The invention claimed is:

1. Three-phase heavy current cable for 50/60 Hz TN-S mains, comprising at least one ground conductor, around which are stranded at least one neutral conductor and a three-phase current conducting element consisting of three phase conductors, and wherein the ground conductor has a smaller cross section than the phase conductors and/or the neutral conductor.

2. Heavy current cable according to claim 1 wherein the stranding factor of the stranding of the phase conductors and the neutral conductor around the ground conductor is <1 meter.

3. Heavy current cable according to claim 1 wherein the ground conductor is straight.

4. Heavy current cable according to claim 1 wherein the phase conductors are not shielded.

5. Heavy current cable according to claim 1 wherein the phase conductors are flexible.

6. Heavy current cable according to claim 1 wherein the ground conductor, the phase conductors and the at least one neutral conductor are wrapped with a strap.

* * * * *